US005834688A

United States Patent [19]

Hill et al.

[11] Patent Number: 5,834,688

[45] Date of Patent: Nov. 10, 1998

[54] ELECTROMAGNETIC INTRUDER DETECTOR SENSOR CABLE

[75] Inventors: Charles Richard Hill, Ottawa; Melvin Clive Maki, Kanata, both of Canada

[73] Assignee: Senstar Stellar Corporation

[21] Appl. No.: 766,003

[22] Filed: Dec. 13, 1996

Related U.S. Application Data

[60] Provisional application No. 60/029,612, Oct. 24, 1996.

[51] Int. Cl. [6] ..... H01B 7/34

[52] U.S. Cl. ..... 174/36; 333/237; 333/243

[58] Field of Search ..... 174/36; 333/237, 333/243, 1

[56] References Cited

U.S. PATENT DOCUMENTS

| | | | |
|---|---|---|---|
| 3,668,573 | 6/1972 | Martin | 333/84 R |
| 3,795,915 | 3/1974 | Yoshida | 333/84 R X |
| 3,963,999 | 6/1976 | Nakajima et al. | 333/84 L |
| 4,157,518 | 6/1979 | McCarthy | 333/237 |
| 4,339,733 | 7/1982 | Smith | 333/237 |
| 4,376,920 | 3/1983 | Smith | 333/12 |
| 4,641,110 | 2/1987 | Smith | 333/12 |
| 4,687,882 | 8/1987 | Stone et al. | 174/102 SC |
| 4,724,277 | 2/1988 | Hindman et al. | 174/23 C |
| 5,247,270 | 9/1993 | Harman et al. | 333/237 |

*Primary Examiner*—Kristine L. Kincaid
*Assistant Examiner*—Marc D. Machtinger
*Attorney, Agent, or Firm*—E. E. Pascal; R. A. Wilkes

[57] ABSTRACT

A sensor cable formed of a center conductor surrounded by dielectric material and first and second layers. The first layer is formed of a gapped conductive material surrounding the dielectric material. The second layer has predetermined conductivity and at least covers the gaps in the conductive material of the first layer. The predetermined conductivity and thickness of the second layer is such that the skin depth in the second layer at an operating frequency of the cable is much greater than the thickness of the second layer, and inductive coupling into or out of the cable through gaps in the second layer is at least an order of magnitude greater than capacitive coupling into or out of the cable through gaps in the second layer.

16 Claims, 1 Drawing Sheet

ELECTROMAGNETIC INTRUDER DETECTOR SENSOR CABLE

This application claims the benefit of U.S. Provisional application No. 60/029,612 filed Oct. 24, 1996.

FIELD OF THE INVENTION

This invention relates to a leaky coaxial cable and in particular to an improved leaky coaxial cable that can be used in an intruder detector.

BACKGROUND TO THE INVENTION

Leaky coaxial cables are used as sensors in intruder detectors such as guided radar intruder detectors. A pair of such cables is buried in a trench or in parallel trenches. An R. F. signal such as at 40.68 MHz is transmitted by one cable and is received by the other cable. The presence of a body such as an intruder in the electromagnetic field surrounding the cables changes the phase and magnitude of the received signal relative to the transmitted signal, which phase and magniude change can be detected and indicated as an intrusion.

The medium in which the cables are buried affects the sensitivity of the system as a whole. For example, different media such as wet earth, dry earth, frozen earth, peat, concrete, gravel, clay, air, etc. affect the electromagnetic field differently from each other. While the sensitivity of the electronic detector connected to the receiving cable could be adjusted if the burial medium were homogeneous, when the cable trench passes through nonhomogeneous burial media, such as passing through wet clay and gravelly earth over different parts of its length, an electronic receiver sensitivity adjustment cannot be done to make the detection sensitivity the same over the entire length of the cables. Thus there can be overly sensitive regions which may be prone to false alarms, and overly insensitive regions which may provide avenues for intrusion without detection.

It has thus been an objective to make a cable sensor which is relatively insensitive to burial media variations. It had been determined, for example as taught in U.S. Pat. No. 4,987,394, assigned to Senstar Corporation that a sensor cable can be improved by employing a second external shield of helically wrapped mumetal tape or stainless seel tape or wires, which second shield is said to stop the electric field but allows the electromagnetic field to pass out of the slot.

U.K. Patent 1,466,171 to Johannessen, published Mar. 2, 1977 describes a radiating coaxial cable having a single gapped shield, in which there is a layer outside the gap of the shield which is made of electrically conducting material having a conductivity which is less than that of the center conductor of the cable. This patent states that the reason for including the layer of material having electrical conductivity which is less than that of the outer conductor, is that current flowing in the outer surface is attenuated and hence the secondary mode is attenuated, and that this should lead to a reduction in the standing wave pattern.

SUMMARY OF THE INVENTION

The present invention has been found to be a considerable improvement over the structure described in the aforenoted U.S. patent for leaky coaxial cables which have long cable length (e.g. 100–200 meters). The present invention considerably reduces capacitive coupling but substantially maintains inductive coupling into or out of the cable. The result is a leaky coaxial cable which can be used as a sensor, but which has substantially reduced sensitivity to burial media variations, since the capacitive coupling can be out of phase with the inductive coupling producing destructive cancellation and non-uniformities. Also capacitive coupling is affected by the external environment making it variable over the cable length if installation passes through different media. This distinguishes from the Johannessen reference which requires the outer conductor only to be covered with a surface wave attenuating material, and does not deal with the problem of reducing or eliminating capacitive coupling while maintaining inductive coupling.

Additional advantages over the structure described in the aforenoted U.S. patent are that inductive coupling is an order of magnitude greater than the capacitive coupling. Therefore, capacitive coupling cannot cancel inductive coupling which results in sensitivity variations; capacitive coupling is reduced without the second external shield consisting of the aforenoted helical wrap of steel tape or wires, and the design is suitable for an automated one pass extrusion process.

In the present invention a leaky (gapped) coaxial cable has a layer overlying the gap or gaps which has a conductivity and thickness such that the skin depth at an operating frequency of the cable is much greater than the thickness of the layer, and that the inductive coupling into or out of the cable through the gap or gaps is at least an order of magnitude greater than the capacitive coupling into or out of the cable at an operating frequency of the cable.

In accordance with an embodiment of the invention, a sensor cable is comprised of a center conductor surrounded by dielectric material, a first layer comprised of a gapped conductive material surrounding the dielectric material, a second layer having predetermined conductivity at least covering the gaps in the conductive material of the first layer, the predetermined conductivity and thickness of the second layer being such that the skin depth in the second layer at an operating frequency of the cable is much greater than the thickness of the second layer, and inductive coupling into or out of the cable through gaps in the second layer is at least an order of magnitude greater than capacitive coupling into or out of the cable through gaps in the second layer.

In accordance with another embodiment, in a leaky coaxial cable that includes a gapped shield, a semiconductor layer overlies gaps in the shield, the conductivity and thickness of the semiconductor material being selected such that inductive coupling into or out of the cable is much greater than capacitive coupling into or out of the cable at an operating frequency of the cable.

BRIEF INTRODUCTION TO THE DRAWINGS

A better understanding of the invention will be obtained by considering the detailed description below, with reference to the following drawings, in which:

FIG. 1 is a side and partly cut-away view of the cable in accordance with an embodiment of the invention, FIG. 2 is a graph of coupling vs volume conductivity of a cable in accordance with an embodiment of the present invention, and FIG. 3 a graph of skin depth vs volume conductivity of an embodiment of the present invention.

DETAILED DESCRIPTION OF AN EMBODIMENT OF THE INVENTION

Figure 1:
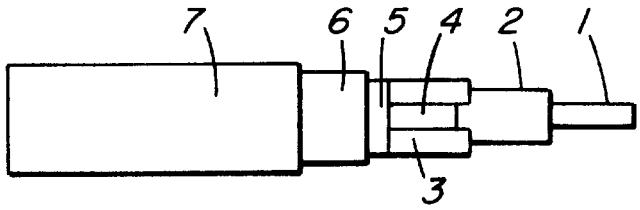

Turning first to FIG. 1, a center conductor 1 is surrounded by a dielectric material 2. This dielectric material 2 is in turn surrounded by gapped foil 3 which can be a metallic laminate such as aluminum and Mylar™. A drain braid 4 is preferably included to provide power handling capability and to improve connector crimping. The drain braid 4 is located opposite to the gap in the foil 3. A flooding compound 5 surrounds the dielectric, metallic laminate and drain braid assembly to reduce damage to the cable in the event of moisture penetrating the jacket through any holes caused by accidental damage to the external jackets 6 and 7.

Semi-conductive polyethylene jacket 6 surrounds the cable assembly. The purpose and exact properties of the semi-conductive jacket 6 is to promote inductive coupling as opposed to capacitive coupling between transmit and receive cables. This is further discussed below. Jacket 7 is a second high density polyethylene protective jacket. This second high density polyethylene jacket protects the cable against incidental damage which could occur when the cable is buried.

The semi-conductive jacket 6 serves two purposes. First and foremost, this jacket promotes inductive coupling between transmit and receive cables. Second, this jacket provides some degree of protection to the cable. This jacket can be replaced with a strip of conductive material which surrounds the cable or simply covers the gap in the foil 3 in which case inductive coupling is still promoted but the protective aspect is only provided by the high density polyethylene protective jacket.

The value of the conductivity chosen for the semi-conductive jacket 6 is critical to the invention. The conductivity must ensure that the inductive coupling is much greater than the capacitive coupling. At the same time the conductivity must not be so high as to reduce the inductive coupling and in order to accomplish this the thickness of the jacket must be much less than a skin depth at the operating frequency of the cable, e.g. 40.68 MHz. These two factors set a range of conductivities for which the sensor will work.

To address the first condition, the jacket 6 must be conductive enough to ensure that inductive coupling is at least an order of magnitude greater than capacitive coupling. The conductive jacket reduces inductive and capacitive coupling resulting in inductive and capacitive insertion losses. The insertion losses are determined by the following equations.

Inductive Insertion Loss=$20\log(1+jw\sigma_S/K1)$ Equation [1]

Capacitive Insertion Loss=$20\log(1+j\sigma_S/wK2)$ Equation [2]

where $w=2\pi f$, and f is the operating frequency and $\sigma_S$ is the surface conductivity given by jacket thickness/volume resistivity of the jacket K1 and K2 are constants.

Figure 2:
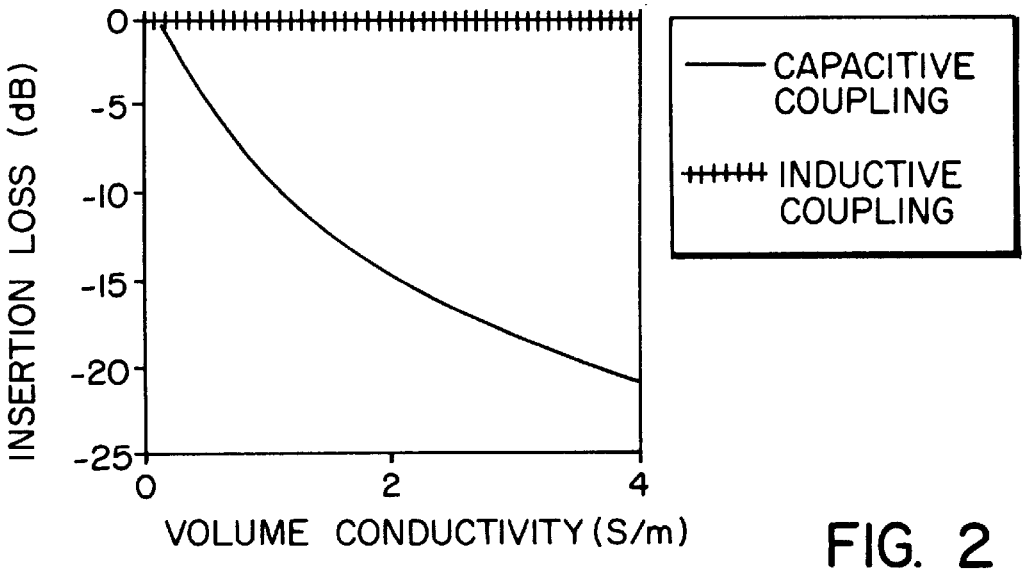

FIG. 2 illustrates how the inductive and capacitive coupling vary as jacket conductivity is increased.

Note that the plotted range of volume conductivity for the jacket is 0 to 4 S/m (Siemens per meter). For values of volume conductivity greater than 1 S/m the inductive coupling is an order of magnitude greater than the capacitive coupling as desired.

Figure 3:
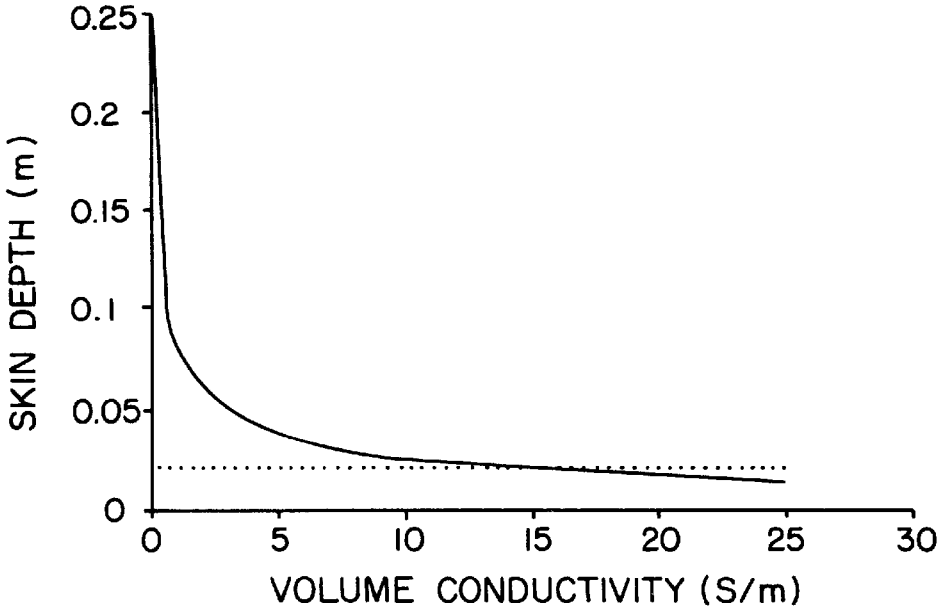

Next, the skin depth is calculated for the conductive jacket, where skin depth $\delta=\mathrm{Sqrt}(1/\pi f\mu\sigma)$ Skin depth is plotted in FIG. 3 vs. volume conductivity $\sigma$.

It is desirable to make the skin depth much greater than the jacket 6 thickness, for example a skin depth at least 10 times greater than the jacket thickness ensures that the signal is not attenuated by the jacket. For a practical jacket thickness in the range of 0.5 mm to 2 mm the skin depth must be greater than 0.02 meters. The line in FIG. 3 represents a skin depth of 0.02 meters and corresponds to a volume conductivity of less than 15 S/m.

The range for practical values of volume conductivity has now been set as:

1 S/m<Volume Conductivity<15 S/m

It has been found that a semi-conductive polyethylene jacket with a volume conductivity between 1 S/m and 15 S/m results in an excellent sensor cable design.

A person understanding this invention may now conceive of alternative structures and embodiments or variations of the above. All those which fall within the scope of the claims appended hereto are considered to be part of the present invention.

We claim:

1. A sensor cable comprising:

(a) a center conductor surrounded by dielectric material, (b) a first layer comprised of a conductive material having at least one gap, surrounding the dielectric material, (c) a second layer having predetermined conductivity at least covering the at least one gap in the conductive material of the first layer, (d) the predetermined conductivity and thickness of the second layer being such that the skin depth in the second layer at an operating frequency of the cable is greater than the thickness of the second layer, and inductive coupling into or out of the cable through gaps in the second layer is at least an order of magnitude greater than capacitive coupling into or out of the cable through gaps in the second layer.

2. A sensor cable as defined in claim 1 in which the second layer is comprised of conductive material.

3. A sensor cable as defined in claim 2 including an insulator separating the first and second layers.

4. A sensor cable as defined in claim 1 in which the second layer is comprised of semiconductive material.

5. A sensor cable as defined in claim 4 including an insulator separating the first and second layers.

6. A sensor cable as defined in claim 5 in which the insulator is a flooding compound.

7. A sensor cable as defined in claim 6 in which the second layer is comprised of semiconductive polyethylene.

8. A sensor cable as defined in claim 5 in which the skin depth is at least 10 times greater than the thickness of the second layer.

9. A sensor cable as defined in claim 5 in which volume conductivity of the second layer is between about 1 and 15 s/m.

10. A sensor cable as defined in claim 8 in which the insulator is a flooding compound.

11. A sensor cable as defined in claim 10 further comprising a protective jacket covering the second layer.

12. A sensor cable as defined in claim 11 in which the protective jacket is comprised of high density polyethylene or polyvinylchloride (PVC).

13. A sensor cable as defined in claim 11 in which the second layer is comprised of semiconductive polyethylene.

14. A sensor cable as defined in claim 10 further including a drain braid extending along the length of the cable in contact with the conductive material of the first layer, and located generally opposite the at least one gap in the first layer.

15. A leaky coaxial cable which includes a gapped shield, a semiconductor layer overlying gaps in the shield, the conductivity and thickness of the semiconductor layer being selected such that inductive coupling into or out of the cable is at least an order of magnitude greater than capacitive coupling into or out of the cable at an operating frequency of the cable.

16. A coaxial cable as defined in claim 15 in which the thickness of the semiconductor layer is much less than a skin depth at the operating frequency of the cable.

* * * * *